US007471905B2

(12) United States Patent
Cook

(10) Patent No.: US 7,471,905 B2
(45) Date of Patent: Dec. 30, 2008

(54) BACKUP OF REPLACEABLE DEVICE INFORMATION IN AN IMAGE-FORMING APPARATUS

(76) Inventor: William Paul Cook, 1143 Rockbridge Rd., Lexington, KY (US) 40515

( * ) Notice: Subject to any disclaimer, the term of this patent is extended or adjusted under 35 U.S.C. 154(b) by 0 days.

(21) Appl. No.: 11/154,178

(22) Filed: Jun. 16, 2005

(65) Prior Publication Data

US 2006/0285859 A1 Dec. 21, 2006

(51) Int. Cl.
*G03G 15/00* (2006.01)

(52) U.S. Cl. ..... 399/24

(58) Field of Classification Search ..... 399/24, 399/18, 19

See application file for complete search history.

(56) References Cited

U.S. PATENT DOCUMENTS 5,016,171 A 5/1991 Connolly et al.
5,132,729 A 7/1992 Matsushita et al.
5,235,384 A 8/1993 Oka et al.
5,272,503 A 12/1993 LeSueur et al.
5,489,971 A * 2/1996 Nam ..... 399/12
5,572,292 A 11/1996 Chatani et al.
5,884,122 A * 3/1999 Kawabuchi et al. ..... 399/88
6,351,621 B1 * 2/2002 Richards et al. ..... 399/111
6,914,696 B1 * 7/2005 Kojima et al. ..... 358/1.16
2002/0018657 A1 * 2/2002 Serizawa ..... 399/27
2004/0223773 A1 * 11/2004 Ito et al. ..... 399/24
2005/0163514 A1 * 7/2005 Hwang ..... 399/12

* cited by examiner

*Primary Examiner*—David M Gray
*Assistant Examiner*—Joseph S. Wong

(57) ABSTRACT

A backup system, apparatus and method to provide a backup of information associated with replaceable devices in an image forming apparatus, such as a color printer. The information may include information representing use of the replaceable devices. The image forming apparatus may include a system memory for storing the replaceable device information. A backup memory may be located on at least one of the replaceable devices to provide a backup of the replaceable device information. The backup memory may allow the replaceable device information to be transferred to another image forming apparatus, for example, when exchanging replaceable devices from a failing apparatus to a replacement apparatus.

17 Claims, 4 Drawing Sheets

BACKUP OF REPLACEABLE DEVICE INFORMATION IN AN IMAGE-FORMING APPARATUS

TECHNICAL FIELD

The present invention relates to an image forming apparatus, including a system and method for backup of replaceable device information.

BACKGROUND INFORMATION

An image forming apparatus, such as a color printer, may include various units, supplies or other devices that may be replaced by the customer, either due to normal life exhaustion or due to unexpected failures. Customer replaceable units (CRUs) may include fusers and transport belts. Supplies may include process cartridges (e.g., toner cartridges), photoconductive units (e.g., PC drums or belts), and waste containers. Information associated with such supplies and CRUs may be stored in non-volatile memory in the image forming apparatus. Such information may be used to control the printer or to indicate to the user the usage or status of each replaceable device.

A printer may also be replaced as part of a repair operation. The old printer may be serviced at a central location (e.g., a depot service center), after a replacement printer is sent to the customer. Supplies and CRUs may not be shipped as part of the replacement printer. Thus, some or all of the supplies and CRUs may be moved from the failing printer into the replacement printer as part of the repair process. If the information associated with the supplies and CRUs is only stored in system memory in the printer, the information may be lost when the replaceable devices are moved to the replacement printer.

SUMMARY

In one exemplary embodiment the present invention is directed to a replaceable device for use in an image forming apparatus that includes at least one replaceable device component and a backup memory device coupled to the replaceable device component. The backup memory device may be configured to store information associated with said replaceable device and other replaceable devices in the image forming apparatus.

In another exemplary embodiment the present invention relates to an image forming apparatus that includes image forming device components including a plurality of replaceable devices and a system memory that may be configured to store replaceable device information. At least one of the replaceable devices includes a backup memory that may be configured to store at least the replaceable device information from the system memory.

In another exemplary embodiment the present invention relates to a method of providing system memory backup in an image forming apparatus. The method includes operating the image forming apparatus and storing replaceable device information in system memory of the image forming apparatus. The replaceable device information may be associated with those replaceable devices that may be utilized in the imaging forming apparatus. One may then perform a backup operation. The replaceable device information from the system memory may therefore be backed up to a backup memory located on at least one of the replaceable devices.

In another exemplary embodiment the present invention relates to a method of supplying information to a system memory in an image forming apparatus. The method includes providing an image forming apparatus with a system memory wherein the apparatus is capable of using replacement devices. One may then provide a replacement device to such apparatus where the replaceable device may include a memory containing information regarding itself and other replaceable devices. The replaceable device memory may then transfer the information in memory to the system memory.

In another exemplary embodiment the present invention relates to an article comprising a storage medium having stored thereon instructions that when executed by a machine result in storing information associated with a plurality of replaceable devices in a first memory in an image forming devices. This then may be followed by transferring the information associated with the plurality of replaceable devices to a second memory on one of the replaceable devices. Additional operations may include comparing the information in the first memory to the second memory and if the information is different, transferring information in the first memory to the second memory. In addition, the operations may include comparing information in the second memory to the first memory and if the information is different, transferring information in the second memory to the first memory.

BRIEF DESCRIPTION OF THE DRAWINGS

These and other features and advantages of the present invention will be better understood by reading the following detailed description, taken together with the drawings wherein.

DETAILED DESCRIPTION

Figure 1:
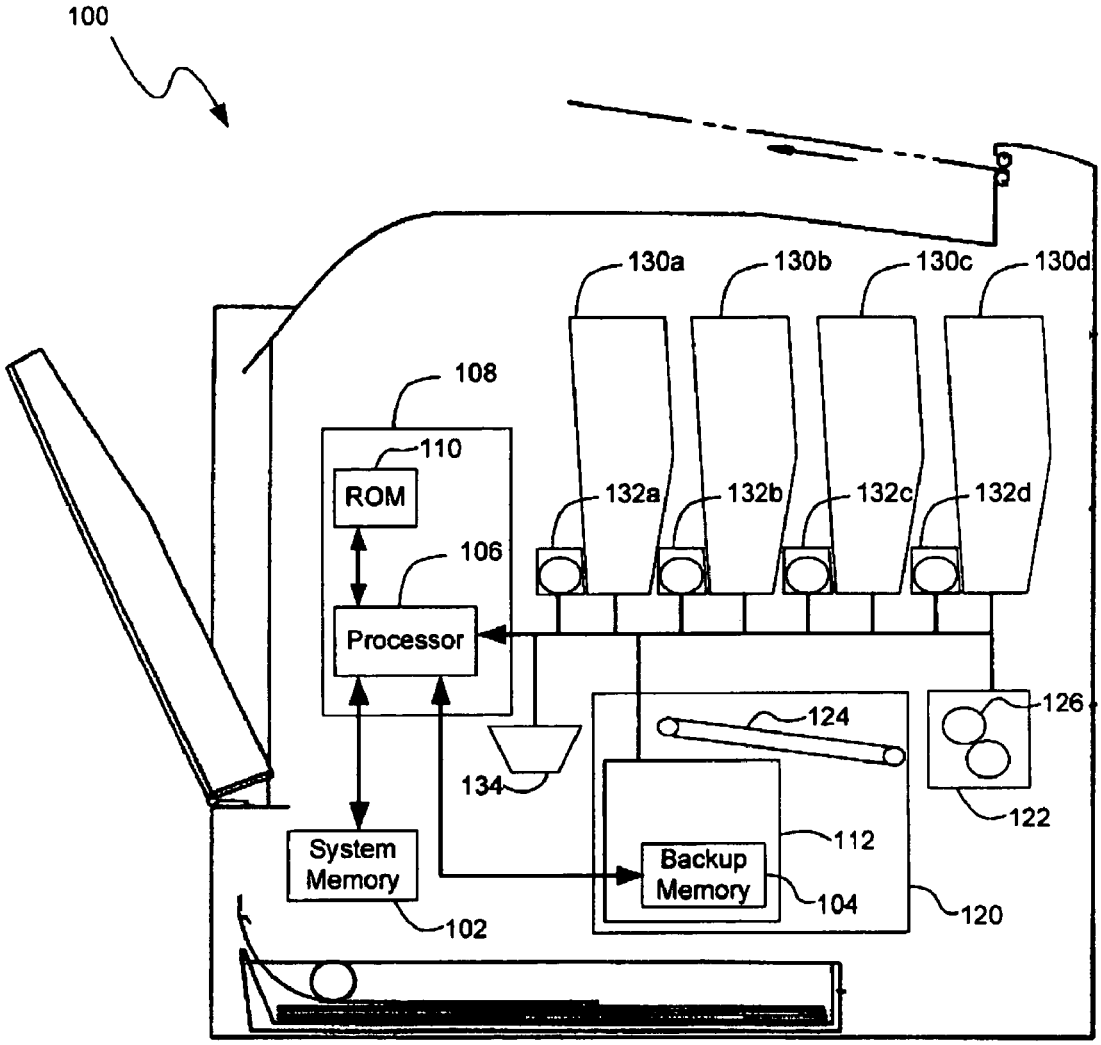
FIG. 1 is a diagrammatic view of an exemplary backup system in an image forming apparatus.

Referring to FIG. 1, an image forming apparatus 100 may use a backup system and method to create a backup of data or information associated with replaceable devices, such as supplies and/or customer replaceable units (CRUs), in the image forming apparatus 100. Accordingly, a replaceable device or unit for an imaging forming device may be understood to include any device which is part of an image forming apparatus and which may therefore be replaced by the user.

The image forming apparatus 100 may include a system memory 102 for storing the replaceable device information. A backup memory 104 may be included and may be located on at least one of the replaceable devices to provide a backup of the replaceable device information. The backup memory 104 may allow the replaceable device information to be transferred to another image forming apparatus, for example, when exchanging replaceable devices from a failing apparatus to a replacement apparatus.

According to one exemplary embodiment, the image forming apparatus 100 may be a color laser printer. Replaceable devices may include CRUs such as a transport belt assembly 120 and a fuser assembly 122. Replaceable devices may also include supplies such as toner cartridges 130*a*-130*d*, photoconductive (PC) units 132*a*-132*d* (e.g., drums and/or belts), or a waste container 134. In the exemplary embodiment, the backup memory 104 may be included in the transport belt assembly 120, although a backup memory may be included in any one or more of the replaceable devices in the image forming apparatus 100.

Each of the replaceable devices may include materials or components, such as materials that may be exhausted and/or moving components that may wear out. For example, the transport belt assembly 120 may include a belt 124 and the fuser assembly 122 may include hot rolls 126. The toner cartridges 130*a*-130*d* may each include toner and moving components for dispensing the toner. The PC units 132*a*-132*d* may include PC drums and/or belts. When these materials and/or components become exhausted or worn out, they may become a replaceable device that may need to be replaced.

The image forming apparatus 100 shown in FIG. 1 has been simplified for ease of understanding and may include other image forming apparatus components known to those skilled in the art. Examples of an image forming apparatus 100 that may use the backup system and method include color laser printers such as the type available from Lexmark International Inc. Those skilled in the art will recognize that the backup system and method may be used with any type of image forming apparatus and any type of replaceable devices for which information may be stored.

The image forming apparatus 100 may include one or more system processors 106 configured to monitor the replaceable devices and to cause the replaceable device information to be stored in the system memory 102 using techniques known to those skilled in the art. According to one embodiment, the system processor(s) 106 may be implemented on an electronics card 108, such as an engine electronics card and/or a raster image processor (RIP) electronics card within a printer such as the type available from Lexmark International Inc. Alternatively, the system processor(s) 106 may be implemented on a system electronics card that includes both the engine electronics and the RIP electronics. The electronics card 108 may also include memory 110, such as ROM, for storing programs or code that control various functions of the image forming apparatus including the operations described herein.

The system memory 102 may be located on the electronics card 108 with the processor or may be located on a separate card or printed circuit board. The system memory 102 and the backup memory 104 may be non-volatile memory devices, such as non-volatile random access memory (NVRAM), coupled to the processor(s) 106 in a manner known to those skilled in the art. NVRAM may be an EEPROM integrated circuit chip or other suitable semiconductor memory device. Other non-volatile memory devices may also be located within the image forming apparatus, for example, on the toner cartridges to store cartridge data, on an operator panel to provide a backup or mirror of system data, or on a laser printhead to store printhead data.

The backup memory 104 may be located on an electronics card located in the replaceable device. When the transport belt assembly 120 includes the backup memory 104, for example, the backup memory 104 may be located on a transport belt sensor card 112, which may interface with one or more sensors used to sense operation of the transport belt assembly. The transport belt sensor card 112 may be coupled to the processor 106 in the image forming apparatus 100, for example, to allow information from the sensor(s) to be monitored and stored in system memory 102. In one embodiment, the backup memory 104 may also be coupled to the sensors via the sensor card 112 to allow information associated with the transport belt assembly 120 to be transferred directly to the backup memory 104 instead of being stored first in system memory 102.

Information associated with the replaceable devices may include life information representing the usage or life of the device. Life information may include a numerical count representing a number of surface movements of the device and/or a numerical page count representing a number of pages handled during the life of the device. Life information associated with the transport belt assembly 120 may include a count of bare belt revolutions and a page count. Life information associated with the fuser assembly 122 may include a count of hot roll revolutions or a page count. Life information associated with toner cartridges 130*a*-130*d* may include a page count, a distance turned (e.g., by the developer roll) or an amount of toner. Life information associated with the PC units 132*a*-132*d* may include a count of PC unit revolutions (e.g., drum or belt revolutions) or a page count. Information associated with the replaceable devices may also include identifying information identifying a particular device, such as a serial number or other alpha-numeric identifier. Other information associated with the devices may also be stored, such as speed calibration data for the fuser assembly 122.

The processor(s) 106 may also be configured to perform the backup operations and to perform the information recovery operations in a replacement apparatus. For example, the processor(s) 106 may execute code located in memory 110 to perform these operations. The code may be implemented using programming techniques known to those skilled in the art. The backup operations and information recovery operations that may be performed by the processor(s) 106 are described in greater detail below.

Figure 2:
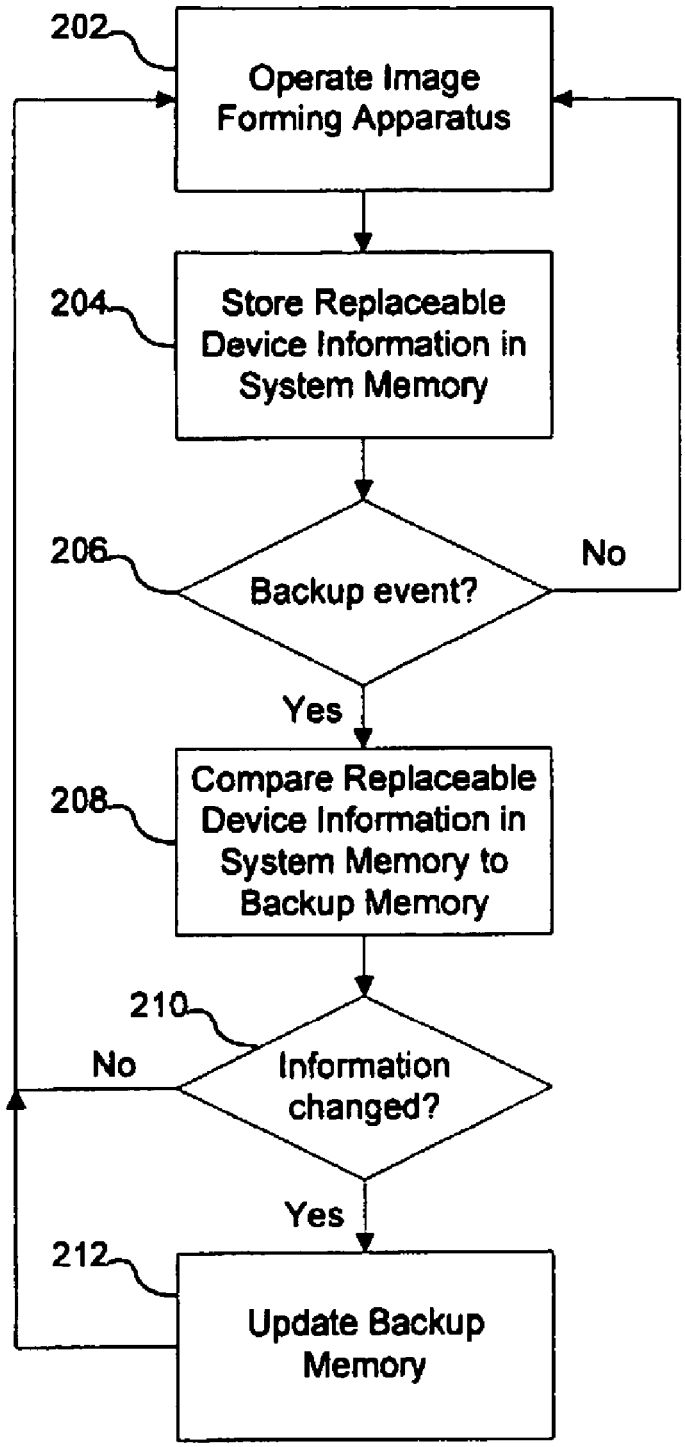
FIG. 2 is a flow chart illustrating one exemplary method of providing a backup of replaceable device information.

Referring to FIG. 2, the backup operations according to one exemplary method are described in greater detail. The image forming apparatus may be operated, operation 202, for example, to create images on a recording medium. During operation, the image forming apparatus components, including the replaceable devices, may perform designated functions within the image forming apparatus 100. For example, the developer cartridges 130*a*-130*d* may dispense developer material or toner to the photoconductive units 132*a*-132*d*, and the waste container 134 may collect waste toner. The transport belt assembly 120 may operate to transport a recording medium with the image formed thereon to the fuser assembly 122.

Prior to initial operation, the system memory and the backup memory in an image forming apparatus may be initialized, for example, by setting the life information to zero for new replaceable devices. As the image forming apparatus operates, the information associated with the operation of the replaceable devices and other components in the image forming apparatus may be stored in the system memory, operation 204. For example, the life information representing usage of the replaceable devices may be updated as the devices are used. Life information may be stored in system memory relatively frequently to prevent such information from being lost, for example, when power is turned off. When a replaceable device has been replaced in an image forming apparatus, the life information associated with that device may be reset to reflect the usage of the new replaceable device.

If the image forming apparatus determines that a backup event occurs, operation 206, the image forming apparatus may perform a backup operation. The backup operation may include comparing replaceable device information in system memory to the information in backup memory, operation 208, to determine if the information has changed, operation 210. If the information has changed, the image forming apparatus may update the backup memory, operation 212, for example, by transferring any new or changed information from the system memory to the backup memory such that the memories are synchronized. Alternatively, a backup operation may include a complete backup of data or information from system memory to backup memory without comparing to determine changes in replaceable device information.

According to another alternative, the image forming apparatus may also be configured such that the backup memory may be updated when the information may have changed since a previous backup. The change may be defined in any number of ways, (e.g., 100 printed pages). Some information may only be copied to backup memory once and may not need to be updated because the information does not change as the device is used. For example, a fuser speed calibration value matching fuser to the belt speed may be written to backup memory at the time it is written to system memory and may not be backed up.

The image forming apparatus may be configured such that backup operations occur at a rate that is low enough so that it may avoid memory fatigue failure and high enough to avoid losing a significant amount of information. Accordingly, the image forming apparatus may therefore be configured such that backup operations may coincide with existing system events that may be performed periodically by the image forming apparatus. In one exemplary embodiment, backup events may be based on a power on cycle, a recovery from a cold start (e.g., when using power saver mode), and/or a recalibration. In this embodiment, even if the image forming apparatus is never powered off and the power saver mode is disabled, a useful backup of the replaceable device information may be available (e.g., based on a recalibration) if the apparatus fails and needs to be replaced. If the recalibrations are disabled, the information may still be backed up at the normal recalibration interval. Backup events may also be based on power on reset (POR) and/or belt jogs.

The frequency of backup events may be reduced further by some factor such that backup events occur at intervals that may be a fraction of the shortest life expectancy of the replaceable devices. In one type of image forming apparatus, for example, the life expectancy of a PC unit may be about 16,000 pages and a desirable backup interval may be every 1,000 pages. If recalibrations are normally performed at 500 page intervals, the backup operation on, e.g., the toner cartridge backup memory device, may be performed every two recalibrations.

During operation of an image forming apparatus, one or more of the replaceable devices (e.g., supplies or CRUs) may be replaced. When such a replacement occurs, information associated with the replaced device may now be updated in the system memory and/or backup memory to reflect the new configuration. In an exemplary embodiment, the devices that may be replaced include toner cartridges, PC units, fuser assemblies, and transport belt assemblies. For example, when a toner cartridge is replaced having back-up memory capability, the information associated with the toner cartridge may first be updated in the system memory automatically. When the PC unit or fuser assembly is replaced, the page counts and/or other life information for the PC unit or fuser assembly may be reset (e.g., manually reset by the user from an operator panel) and copied from the system memory to the toner cartridge back-up memory. In addition, when the belt assembly is replaced, the counts for the belt may be reset automatically from the backup memory on the belt assembly. The new information regarding the belt assembly may then be similarly copied from the system memory to the backup memory.

In some cases, replaceable devices may be exchanged between two image forming units, where one replaceable device has back-up information regarding the various replaceable devices and one replaceable device does not have such back-up information. Therefore, when a replaceable device is exchanged after having been used, the life information associated with the replaceable device may be lost if a device with the backup information is not simultaneously exchanged. To avoid loss of information, the user may update the information manually, for example, using an operator panel on the image forming apparatus. Alternatively, as noted, the replaceable device disclosed herein with the backup information may be conveniently exchanged along with a replaceable device that does not have backup information, to thereby ensure against loss of information.

It has therefore been possible that fuser assemblies or PC units or other replaceable devices may be exchanged in an image forming apparatus, under circumstances where their associated life information may not be supplied to the apparatus system memory. As a result, the life information associated with the exchanged devices may be too high on one apparatus and may be too low on another apparatus. This may lead to premature replacement in one apparatus and delayed or overdue replacement in another apparatus, e.g. a replacement done under warranty when such replacement was not a qualifying warranty replacement. As noted above, should such replaceable devices be exchanged with a replaceable device herein that contains back-up information, such problems may be avoided.

In accordance with the present invention, belt assemblies (having replaceable device back-up information) may be exchanged or swapped with the fuser assemblies and/or PC units so that the information associated with the fuser assemblies and/or PC units may be transferred from the backup memory. Furthermore, the operator panel may be used to indicate which devices have been exchanged so that the correct information may be updated from backup memory to the system memory. For example, the operator panel may query the user as to whether or not the fuser information and/or the PC unit information should also be transferred with the belt and the system memory may be updated accordingly. Alternatively, the PC unit information may be transferred automatically because it is more common for the PC unit to be moved with the belt assembly.

Expanding on the above, when transport belt assemblies are now exchanged or swapped the belt usage information may now travel with the belt assemblies and no information is lost. In this case, the image forming apparatus may recognize that the exchange has occurred because the system memory and the backup memory on the belt do not match. The belt serial number may be used to make the determination that the belt has been replaced and the belt information may be automatically updated from the backup memory on the belt to the system memory. Furthermore, the user may now be queried to see if other information (e.g., life information regarding other replaceable devices) should be transferred from the backup memory in the belt assembly to the system memory. If the fuser assembly and PC unit have not been exchanged with the belt assembly, the system memory may then automatically update the information associated with the fuser assembly and PC unit in the backup memory of the exchanged belt assembly.

Figure 3:
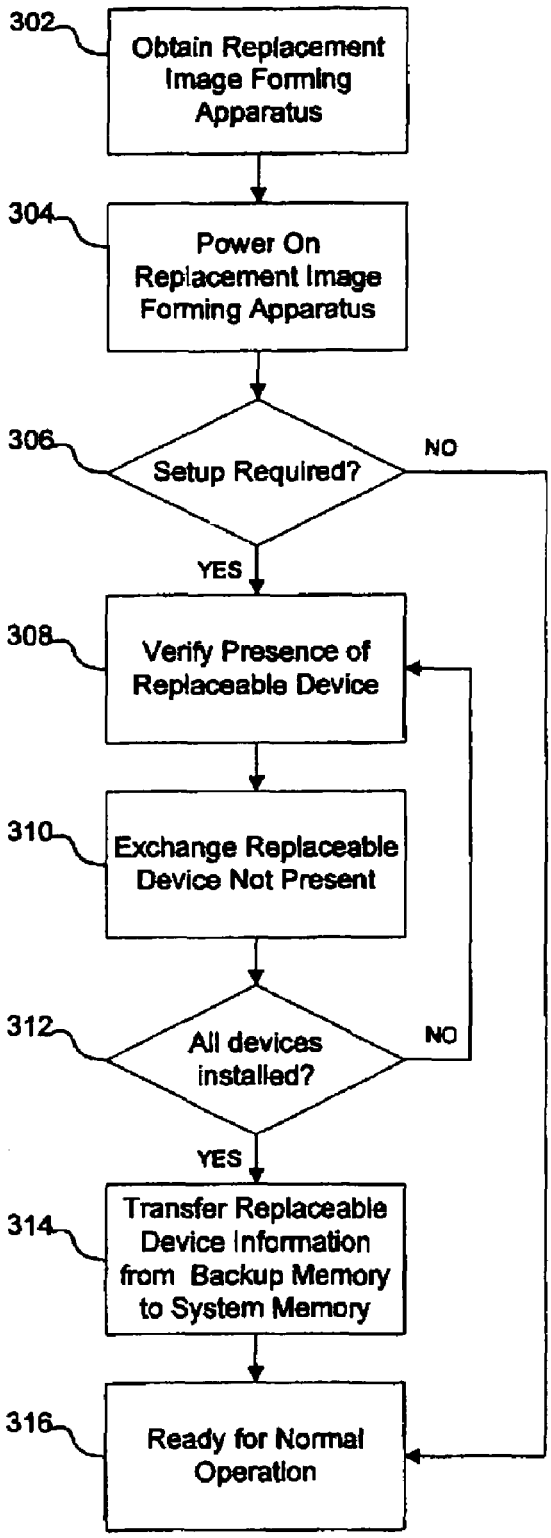
FIG. 3 is a flow chart illustrating one exemplary method of recovering replaceable device information in a replacement apparatus.

Referring to FIG. 3, the information recovery operations according to one exemplary method are now described in greater detail, and in particular, for the situation where the user obtains a replacement image forming apparatus. When an image forming apparatus needs to be replaced or repaired (e.g., because it is failing), the replacement image forming apparatus may therefore be obtained, operation 302. The replacement apparatus may be provided, for example, from a depot service center, without supplies and/or without Customer Replaceable Unites (CRUs). Such a replacement apparatus is sometimes referred to as a shell and requires installation of the missing supplies and/or CRUs before normal operation begins. Accordingly, a flag may be set in memory of the replacement apparatus at the factory or depot center to bring the replacement apparatus up in a special mode or "set up required" state when it is first turned on. The "set up required" state indicates that it is a replacement apparatus and set up is required, for example, by installing supplies and CRUs.

When the replacement apparatus is powered on, operation 304, the apparatus may determine that set up is required, operation 306, and may then verify the presence of replaceable devices in the replacement apparatus, operation 308. For example, the verification operation may be performed in the "set up required" state by looking for the CRUs (e.g., fuser and transport belt) and supplies (e.g., toner cartridges, PC drums, waste container). In one embodiment, the verification may include sensing the presence of each supply or CRU using sensors within the apparatus. When the verification operation indicates that replaceable devices are not present in the replacement apparatus, the replaceable devices may be exchanged from the old apparatus, operation 310.

In accordance with this exemplary embodiment of the present invention, when the replaceable devices are installed, operation 312, replaceable device information may now be transferred from the backup memory on one of the replaceable devices to the system memory of the replacement apparatus, operation 314. The particular information that is transferred may of course depend on the replaceable devices that have been installed into the replacement apparatus. In general, the information that may be uploaded to the system memory of the replacement apparatus may now be the backup information associated with the devices that have been installed.

Expanding upon the above, a replacement image forming apparatus or shell may be shipped without the transport belt assembly, the fuser assembly and the supplies (e.g., PC units and toner cartridges). In this embodiment, the life information in system memory of the replacement image forming apparatus may be reset to zero for the transport belt assembly, fuser assembly and the supplies. In an alternative embodiment, a replacement image forming apparatus or shell may be shipped with a fuser assembly but without the transport belt assembly and without the supplies. In this alternative embodiment, the life information associated with the transport belt and the supplies may be reset to zero, while the life information associated with the fuser may be left as a non-zero value in the system memory, reflecting the actual usage of the fuser assembly in the shell. When a shell is shipped with a fuser assembly, the replacement apparatus may then recognize during set up that the system memory data has not been reset for the fuser assembly. In this case, the image forming apparatus may assume the system memory data for the fuser is correct and may not transfer fuser information from the backup memory. Instead, the data or information associated with the fuser may actually be copied to the backup memory in the exchanged belt assembly.

Once the set up has been completed (e.g., devices installed and necessary information transferred), the replacement image forming apparatus is now made ready for normal operation, operation 316. During normal operation of the replacement apparatus, backup operations may be performed, for example, according to the method described above and shown in FIG. 2. The replaceable devices may again be exchanged, for example, to another replacement image forming apparatus or back to the original image forming apparatus that has been serviced. If the replaceable devices are again exchanged, the replaceable device information on the backup memory may be transferred again to the system memory in the new replacement apparatus or in the original apparatus.

Figure 4:
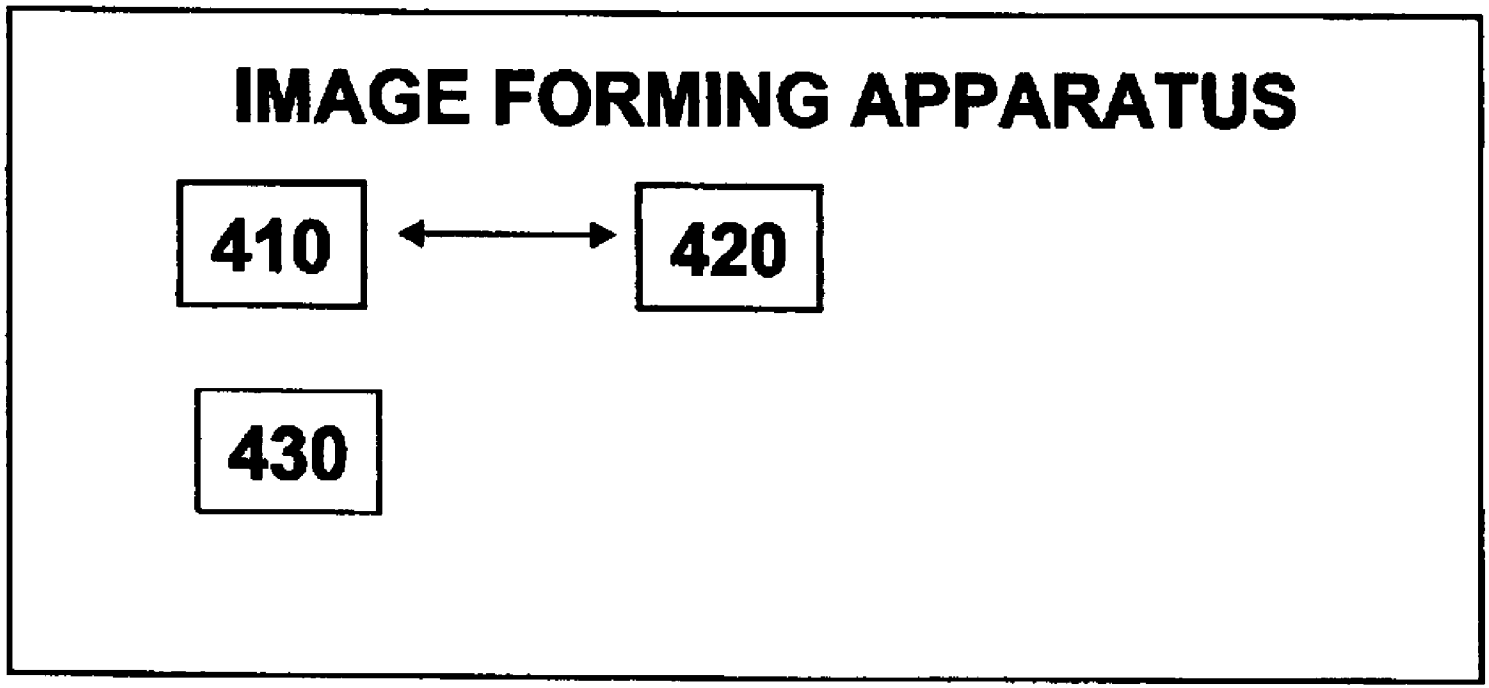
FIG. 4 is an illustration of an embodiment of the present invention relating to an article of machine readable media in relation to a processor and a user interface.

It should also be appreciated that the functionality described herein for the embodiments of the present invention may be implemented by using hardware, software, or a combination of hardware and software, either within the image forming device or outside the image forming device, as desired. If implemented by software, a processor and a machine readable medium are required. The processor may be of any type of processor capable of providing the speed and functionality required by the embodiments of the invention. Machine-readable memory includes any media capable of storing instructions adapted to be executed by a processor. Some examples of such memory include, but are not limited to, read-only memory (ROM), random-access memory (RAM), programmable ROM (PROM), erasable programmable ROM (EPROM), electronically erasable programmable ROM (EEPROM), dynamic RAM (DRAM), magnetic disk (e.g., floppy disk and hard drive), optical disk (e.g. CD-ROM), and any other device that can store digital information. The instructions may be stored on medium in either a compressed and/or encrypted format. Accordingly, in the broad context of the present invention, and with attention to FIG. 4, the image forming device may contain a processor 410 and machine readable media 420 and user interface 430.

Accordingly, a backup system and method consistent with embodiments of the present invention may be used to backup life information associated with one or more replaceable devices in an image forming apparatus onto a backup memory in one or more of the replaceable devices. The backup system and method may allow such information to be recovered when the replaceable devices are moved to a replacement apparatus.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A transport belt assembly for use in an image forming apparatus, said transport belt assembly comprising:

a transport belt; and a non-volatile memory device configured to store backup information associated with said transport belt assembly and at least one other replaceable device in said image forming apparatus, said at least one other replaceable device being outside of and separate from the transport belt assembly, and said at least one other replaceable device being without any storage of backup information associated with said at least one other replaceable device, wherein said at least one other replaceable device includes any one of a toner cartridge, a fuser assembly, and a photoconductive unit, and wherein said backup information includes information representing use of the transport belt assembly and information representing use of any one of the toner cartridge, the fuser assembly, and the photoconductive unit.

2. The transport belt assembly of claim 1 wherein said information comprises a page count.

3. An image forming apparatus comprising:

image forming apparatus components including a plurality of replaceable devices, wherein said replaceable devices comprise a toner cartridge, a transport belt assembly, a fuser assembly, and a photoconductive unit;

system memory configured to store information associated with said image forming apparatus including replaceable device information associated with said plurality of replaceable devices, wherein said replaceable device information includes information representing use of said toner cartridge, said transport belt assembly, said fuser assembly, and said photoconductive unit, and wherein said system memory is a non-volatile memory device; and wherein at least one of said toner cartridge, said transport belt assembly, said fuser assembly, and said photoconductive unit includes a replaceable device memory configured to store a backup, from system memory, of said replaceable device information associated with others of said plurality of replaceable devices and said replaceable device information associated with said at least one of said toner cartridge, said transport belt assembly, said fuser assembly, and said photoconductive unit.

4. The image forming apparatus of claim 3 wherein said transport belt assembly includes said replaceable device memory configured to store said backup.

5. The image forming apparatus of claim 3 further comprising a processor capable of causing said replaceable device information in said system memory to be stored in said replaceable device memory.

6. The image forming apparatus of claim 5 wherein said processor is capable of detecting an event and capable of performing a backup operation upon detection of said event, wherein said backup operation comprises storing said replaceable device information to said replaceable device memory.

7. The image forming apparatus of claim 6 wherein said event comprises any one of a power on cycle, a recovery from a cold start, a recalibration, and a belt jog.

8. A method of providing system memory backup in an image forming apparatus, said method comprising:

providing an image forming apparatus including a plurality of replaceable devices, said replaceable devices including a transport belt assembly, a fuser assembly, a photoconductive unit, and a toner cartridge, wherein at least one of said transport belt assembly, said fuser assembly, said photoconductive unit, and said toner cartridge includes replaceable device memory;

storing replaceable device information in system memory of said image forming apparatus, said replaceable device information being associated with said plurality of replaceable devices in said image forming apparatus and including information representing use of said replaceable devices; and performing a backup operation, wherein said replaceable device information associated with said plurality of replaceable devices is backed up from said system memory to said replaceable device memory such that said replaceable device memory in said at least one of said transport belt assembly, said fuser assembly, said photoconductive unit, and said toner cartridge stores a backup of said replaceable device information associated with said at least one of said transport belt assembly, said fuser assembly, said photoconductive unit, and said toner cartridge and said replaceable device information associated with others of said plurality of replaceable devices, wherein said information remains stored in said system memory and is updated in said system memory, after transferring said information to said replaceable device memory.

9. The method of claim 8 wherein performing said backup operation comprises:

comparing said replaceable device information in said system memory to said replaceable device memory; and if said information is different, transferring said replaceable device information in said system memory to said replaceable device memory.

10. The method of claim 8 wherein said backup operation is performed at intervals.

11. The method of claim 8 further comprising detecting a backup event, wherein said backup operation is performed upon detection of said backup event.

12. The method of claim 11 wherein said backup event is based on a system event comprising any one of a power on cycle, a recovery from a cold start, a recalibration, and a belt jog.

13. The method of claim 8 wherein said transport belt assembly includes said replaceable device memory, and wherein performing the backup operation includes backing up to said replaceable device memory in said transport belt assembly at least said replaceable device information associated with said transport belt assembly, said fuser assembly, said photoconductive unit and said toner cartridge.

14. A method of supplying information to a system memory in an image forming apparatus, said method comprising:

providing an image forming apparatus with a system memory, said apparatus capable of using a plurality of replaceable devices, wherein said replaceable devices comprise a toner cartridge, a transport belt assembly, a fuser assembly, and a photoconductive unit;

providing a plurality of said replaceable devices including any one of said toner cartridge, said transport belt assembly, said fuser assembly, and said photoconductive unit in said image forming apparatus, wherein at least one of said toner cartridge, said transport belt assembly, said fuser assembly, and said photoconductive unit includes a memory containing backup replaceable device information regarding said at least one of said toner cartridge, said transport belt assembly, said fuser assembly, and said photoconductive unit and backup replaceable device information regarding others of said plurality of replaceable devices, and wherein said replaceable device information includes information representing use of said replaceable devices; and responsive to installing said replaceable devices, transferring said backup replaceable device information associated with said plurality of replaceable devices from said replaceable device memory in said at least one of said toner cartridge, said transport belt assembly, said fuser assembly, and said photoconductive unit to said system memory.

15. An article comprising:

a storage medium having stored thereon instructions that when executed by a machine result in the following operations:

storing information associated with a plurality of replaceable devices in a first memory in an image forming apparatus, wherein said replaceable devices comprise a toner cartridge, a transport belt assembly, a fuser assembly, and a photoconductive unit, and wherein said replaceable device information includes information representing use of said replaceable devices;

transferring said information associated with said plurality of replaceable devices to a second memory on one of said toner cartridge, said transport belt assembly, said fuser assembly, and said photoconductive unit to provide a backup of said information for said replaceable devices, wherein said information remains stored in said first memory and is updated in said first memory, after transferring said information to said second memory.

16. The article of claim 15, wherein said instructions that when executed by said machine result in the following additional operations:

comparing said information in said first memory to said second memory; and if said information is different, transferring information in said first memory to said second memory.

17. The article of claim 15, wherein said instructions that when executed by said machine result in the following additional operations:

comparing said information in said second memory to said first memory; and if said information is different, transferring information in said second memory to said first memory.

* * * * *